United States Patent [19]

Yuasa et al.

[11] Patent Number: 4,804,795

[45] **Date of Patent: * Feb. 14, 1989**

[54] HIGH-DENSITY FUEL OIL

[75] Inventors: Hitoshi Yuasa; Mitsuo Matsuno; Hirosuke Imai, all of Yokohama, Japan

[73] Assignee: Nippon Oil Co., Ltd., Japan

[ * ] Notice: The portion of the term of this patent subsequent to Aug. 5, 2003 has been disclaimed.

[21] Appl. No.: 153,502

[22] Filed: Feb. 2, 1988

Related U.S. Application Data

[63] Continuation of Ser. No. 937,225, Dec. 3, 1986, abandoned.

[30] Foreign Application Priority Data

Dec. 5, 1985 [JP] Japan ..... 60-273976

[51] Int. Cl.[4] ..... C07C 13/28; C07C 2/50

[52] U.S. Cl. ..... 585/21; 252/9; 252/73; 585/14; 585/22; 585/360; 585/361; 585/362

[58] Field of Search ..... 585/14, 21, 22, 360, 585/361, 362; 252/73, 9

[56] References Cited

U.S. PATENT DOCUMENTS

| | | | |
|---|---|---|---|
| 3,144,491 | 8/1964 | O'Conner | 585/21 |
| 4,059,644 | 11/1977 | Cannell | 585/21 |
| 4,177,217 | 12/1979 | Janoski et al. | 585/253 |
| 4,355,194 | 10/1982 | Norton et al. | 585/14 |
| 4,394,528 | 7/1983 | Fisher | 585/14 |
| 4,398,978 | 8/1983 | Burdette et al. | 585/253 |
| 4,401,837 | 8/1983 | Burdette et al. | 585/253 |
| 4,507,516 | 3/1985 | Hirooka et al. | 585/14 |
| 4,604,490 | 8/1986 | Yuassa et al. | 585/21 |

*Primary Examiner*—Asok Pal

*Attorney, Agent, or Firm*—Ostrolenk, Faber, Gerb & Soffen

[57] ABSTRACT

The present invention provided a high-density fuel oil comprising an isomerized product prepared by isomerizing an alicyclic saturated hydrocarbon represented by the following formula in the presence of an acid catalyst:

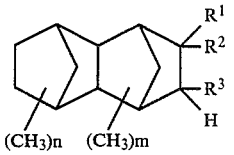

wherein each of m and n is 0 or 1, and each of $R^1$ to $R^3$ is a hydrogen atom or an alkyl group having 1 to 3 carbon atoms, but the number of the total carbons of $R^1$ to $R^3$ is within the range of 1 to 3.

5 Claims, No Drawings

HIGH-DENSITY FUEL OIL

This is a continuation of application Ser. No. 937,225 filed on Dec. 3, 1986, now abandoned.

BACKGROUND OF THE INVENTION (1) Field of the Invention

The present invention relates to a high-density fuel, and more particularly to a high-density and high energy liquid fuel used for jet propulsion of rockets or jet engines.

(2) Description of the Prior Art

In a rocket or a jet engine for a turbo jet, a ram jet, a pulse jet or the like, a high-energy liquid fuel is used. In order to increase the propulsion force of such a jet engine, a fuel having a high combustion energy per unit weight, i.e., a high-density and high-combustion heat release liquid fuel is required. The liquid fuel for jet engines is fed to a combustion chamber through a pipe, but since a flying object carrying the jet engine flies at a high altitude and since liquid oxygen is also used, the liquid fuel will be exposed to an extremely low temperature. Therefore, other requirements of the liquid fuel for jet engines are to have a low freezing point and a low pour point, and to possess a moderate viscosity even at a low temperature. Further, it is also necessary that the liquid fuel for jet engines has no unsaturated bonds and can be stored stably for a long period of time.

As such liquid fuels for jet engines, there have been known exo-tetrahydrodicyclopentadiene (JP-10; Japanese Patent Publication No. 20977/1970) which can be prepared by the isomerization of hydrogenated dicyclopentadiene with an acid catalyst, and a compound which can be prepared by hydrogenating a dimer of norbonadiene (RJ-5; U.S. Pat. No. 3,377,398). The aforesaid JP-10 is good in fluidity at a low temperature but is low in density, and its heat of combustion per unit volume is disadvantageously small. On the other hand, the aforesaid RJ-5 has a large heat of combustion per unit volume, but its fluidity at a low temperature is poor. Moreover, the RJ-5 has the drawback of being difficult to synthesize and being expensive.

OBJECT OF THE INVENTION

An object of the present invention is to provide a high-density and high-energy liquid fuel which satisfies the above-mentioned requirements necessary for a liquid fuel for jet engines and which can easily be prepared at a low cost on an industrial scale.

SUMMARY OF THE INVENTION

The inventors of the present application have previously found that an alicyclic saturated hydrocarbon (I) represented by the following general formula is effective as a high-density fuel oil:

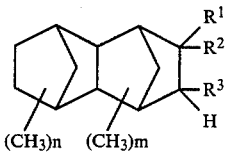

(I)

wherein each of m and n is 0 or 1, and each of $R^1$ to $R^3$ is a hydrogen atom or an alkyl group having 1 to 3 carbon atoms, but the number of the total carbons of $R^1$ to $R^3$ is within the range of 1 to 3.

The present inventors have further conducted intensive research with the intention of improving the performance of the high-density fuel oil. As a result, it has been found that the freezing point which is one of important physical properties of the high-density fuel oil is additionally improved by isomerizing the above saturated hydrocarbon (I) in the presence of an acid catalyst, and in consequence, the present invention has now been completed.

That is, the present invention is directed to a high-density and high-energy liquid fuel for jet engines comprising an isomerized product prepared by isomerizing an alicyclic saturated hydrocarbon (I) represented by the following general formula in the presence of an acid catalyst:

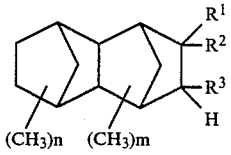

(I)

wherein each of m and n is 0 or 1, and each of $R^1$ to $R^3$ is a hydrogen atom or an alkyl group having 1 to 3 carbon atoms, but the number of the total carbons of $R^1$ to $R^3$ is within the range of 1 to 3.

DESCRIPTION OF THE PREFERRED EMBODIMENTS

An alicyclic saturated hydrocarbon represented by a formula (I) used in the present invention can be synthesized through a route consisting of the following formulae (1) to (3) by the utilization of the Diels-Alder reaction and hydrogenation.

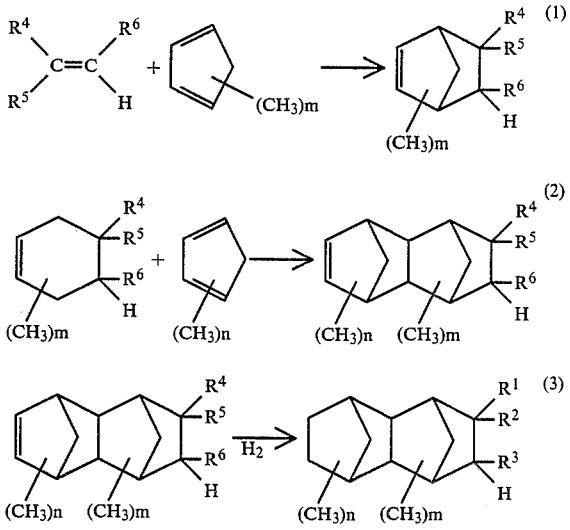

(I)

wherein each of m and n is 0 or 1, each of $R^1$ to $R^3$ is a hydrogen atom or an alkyl group having 1 to 3 carbon atoms, each of $R^4$ and $R^5$ is a hydrogen atom, an alkyl or an alkenyl group having 1 to 3 carbon atoms, but the total carbon number of $R^1$ to $R^3$ is within the range of 1 to 3, and the total carbon number of $R^4$ and $R^5$ is within the range of 1 to 3.

Further, the alicyclic saturated hydrocarbon can be synthesized by the use of an alkylidene norbornene as follows:

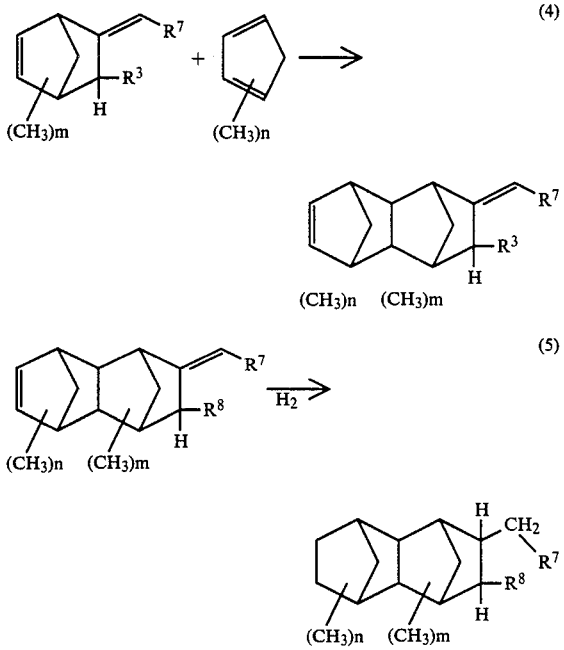

wherein each of m and n is 0 or 1, and each of $R^7$ and $R^8$ is a hydrogen atom or an alkyl group having 1 or 2 carbon atoms, but the number of the total carbons of $R^7$ to $R^8$ is within the range of 0 to 2.

The thus obtained alicyclic saturated hydrocarbon represented by the general formula (I) can be employed as a high-density fuel oil directly without any additional treatment, but if this hydrocarbon is isomerized in the presence of an acid catalyst, the freezing point will fall, whereby the performance of the hydrocarbon as the high-density fuel oil can be further improved.

Examples of the acid catalysts used in this isomerization include aluminum chloride, aluminum bromide, iron chloride, tin chloride, titanium chloride, sulfuric acid, hydrochloric acid, hydrogen fluoride, boron trifluoride, antimony pentafluoride, trifluoromethanesulfonic acid and sulfonic acid fluoride. In addition, as the acid catalysts, there can also be used zeolite and solid acids prepared by combining the zeolite and Mg, Ca, Sr, Ba, B, Al, Ga, Se, Pt, Re, Ni, Co, Fe, Cu, Ge, Rh, Os, Ir, Mo, W, Ag and the like. Such an acid catalyst may be employed in an amount of 0.1 to 20% by weight, preferably 1 to 10% by weight based on the alicyclic saturated hydrocarbon (I).

The above mentioned isomerization reaction may be carried out in the absence of any solvent or in a solvent such as an alicyclic saturated hydrocarbon or a halogenated saturated hydrocarbon. Examples of such solvents include hexane, heptane, decane, methylene chloride, methylene bromide, chloroform, 1,2-dichloroethane, 1,2-dichloropropane and 1,4-dichlorobutane. The amount of the solvent to be used is not limited particularly, but in general, it is 1 to 6 times as much as that of the alicyclic saturated hydrocarbon (I).

The temperature for the isomerization reaction is within the range of −20° to 100° C., preferably 10° to 80° C., and as to the time necessary for the isomerization reaction, it varies with the reaction temperature and other conditions but is generally within the range of 0.1 to 10 hours.

In the practice of the aforesaid isomerization reaction, any reaction mode such as a batch process, a semi-batch process or a continuous process can be adopted. After the removal of the used catalyst therefrom or its deactivation, the resulting isomerized product can be purified by means of distillation or the like.

The isomerized product obtained according to the present invention is a mixture of many isomers. It is difficult to identify structures of these isomers, but as a few examples thereof, the following compounds can be presumed:

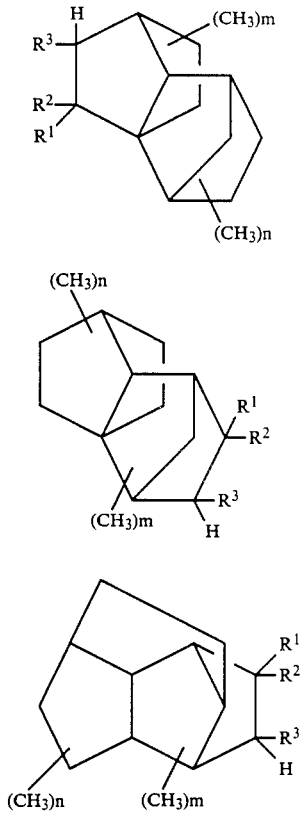

In addition to these compounds, other isomers can also be presumed such as adamantane derivatives and rearranged products in which the substituents of $R^1$ to $R^3$ have taken part in the reaction.

The isomerized product of the alicyclic saturated hydrocarbon (I) represented by the following general formula also has a high density and gives off a high energy similarly to the alicyclic saturated hydrocarbon (I) which is the raw material of the isomerized product.

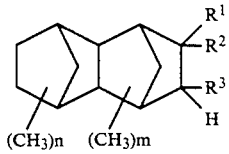

wherein each of m and n is 0 or 1, and each of $R^1$ to $R^3$ is a hydrogen atom or an alkyl group having 1 to 3 carbon atoms, but the number of the total carbons of $R^1$ to $R^3$ is within the range of 1 to 3.

Further, the isomerized product has a melting point of −70° C. and therefore is excellent particularly in fluidity properties at low temperature.

Moreover, the alicyclic compound (I) which is the raw material in the present invention can be prepared by using inexpensive starting materials, for example, unsaturated hydrocarbons such as propylene, butenes, pentenes, butadiene, piperylene and isoprene; cyclopentadiene, methylcyclopentadiene, dicyclopentadiene and dimethylcyclopentadiene. In addition, the isomerization reaction of the alicyclic compound (I) can also be carried out at a low temperature and in a high yield. Therefore, the liquid fuel of the present invention has the advantage that its synthesis can be accomplished at a lower cost than a conventional jet fuel. Furthermore, the liquid fuel of the present invention has advantages of a good chemical stability, a storage stability for a long time and a non-corrosiveness to metals.

The liquid fuel according to the present invention can be used alone as a fuel for jet engines but may be also utilized in the form of a combination of it and another known fuel liquid. Examples of the known fuels which can be mixed with the liquid fuel of the present invention include exo-tetrahydrodicyclopentadiene, a hydride of a dimer of norbornadiene known as RJ-5, hydrogenated products of trimers of cyclopentadiene and methylcyclopentadiene, di- or tricyclohexylalkanes, mono- or dicyclohexyldicyclic alkanes, naphthenic hydrocarbons and isoparaffinic hydrocarbons.

Now, the present invention will be described in detail in reference to examples, but the latter do not intend to limit the scope of the present invention.

EXAMPLE 1

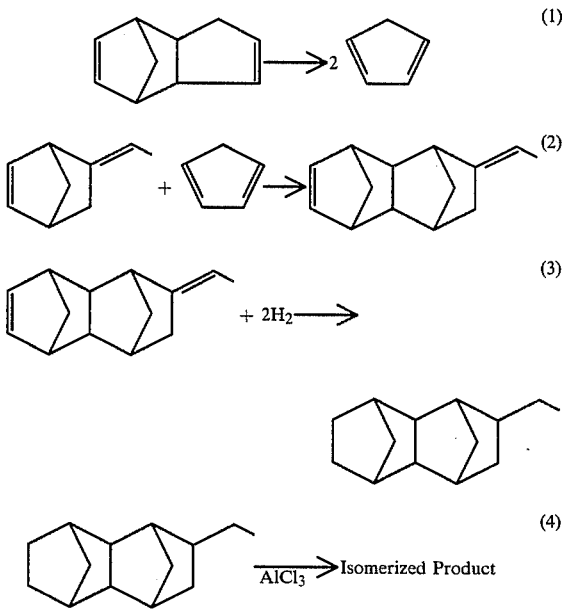

In a 2-liter stainless steel autoclave in which the atmosphere had been replaced with nitrogen were placed 359 g of 5-ethylidenenorbornene-2 and 230 g of dicyclopentadiene, and a reaction was then performed at 167° C. for 21 hours. After the reaction was over, the resulting reaction solution was subjected to a vacuum distillation, so that an adduct (86° C./1 mmHg) of 5-ethylidenenorbornene-2 and cyclopentadiene in a ratio of 1:1 was obtained in an amount of 395 g.

In this Diels-Alder reaction, a conversion of 5-ethylidenenorbornene-2 was 76%, and a yield of the 1:1 adduct of 5-ethylidenenorbornene-2 and cyclopentadiene was 71%.

The thus obtained 1:1 adduct was then hydrogenated as follows:

In the 2-liter stainless steel autoclave were placed 390 g of the 1:1 adduct synthesized in the aforesaid manner and 3.4 g of a palladium-carbon catalyst in which 5% of palladium was supported, and a reaction was then performed at 30° C., while maintaining a hydrogen pressure at 8 kg/cm$^2$. When the reaction had progressed for 20 hours, the feed of hydrogen was stopped. At this point of time, it was confirmed that hydrogen was not absorbed any more, and thus the reaction was brought to an end. The used catalyst was filtered off, and a vacuum distillation was then carried out in order to prepare 391 g of a hydrogenated product (66° C./0.3 mmHg) of the 1:1 adduct.

For the thus obtained hydrogenated product of the 1:1 adduct of 5-ethylidenenorbornene-2 and cyclopentadiene, an isomerization reaction was afterward performed as follows:

Into a 1-liter three-neck flask equipped with a stirrer, a condenser and a dropping funnel were introduced 5 g of aluminum chloride and 100 ml of 1,2-dichloroethane, and a solution of 100 g of the aforesaid hydrogenated product and 100 ml of 1,2-dichloroethane was then added slowly with stirring to the flask over 1 hour at room temperature by the use of the dropping funnel. Afterward, a reaction was allowed to go on at 45° C. for 4 hours.

After the reaction was over, water was added thereto in order to decompose the aluminum chloride, and the oil layer was then washed with water. After dehydration, a vacuum distillation was carried out in order to prepare 97 g of an isomerized product of the aforesaid hydrogenated product at a boiling point of 62° to 70° C./0.3 mmHg.

For the thus obtained isomerized product, a gas chromatography analysis was carried out, whereby it was found that the isomerized product contained many components which were all isomers having a molecular weight of 190. Further, according to a $^1$H-NMR analysis, it was confirmed that the isomerized product showed no absorption at $\sigma$ of 3.7 to 7.0 ppm and had no unsaturated bonds.

This isomerized product has a freezing point of −78° C. or less, its specific gravity being 0.981 (15° C./4° C.), its net heat of combustion being 10,050 cal/g, its viscosity being 60 cSt (−20° C.).

EXAMPLE 2

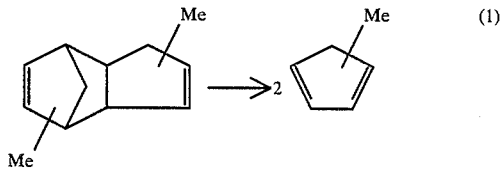

-continued (2)

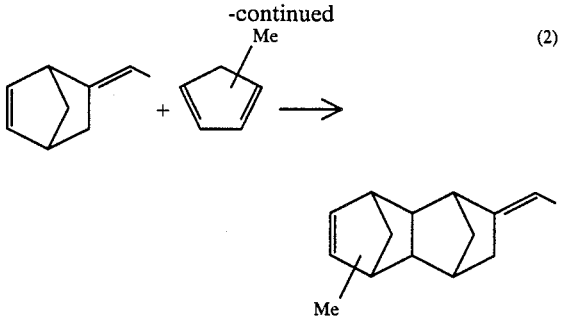

(3)

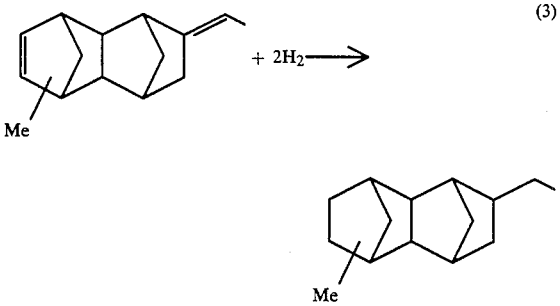

(4)

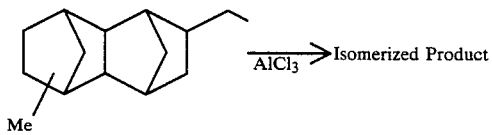

In a 2-liter stainless steel autoclave in which an atmosphere had been replaced with nitrogen were placed 400 g of 5-ethylidenenorbornene-2 and 360 g of dimethyldicyclopentadiene, and a reaction was then performed at 175° C. for 12 hours. After the reaction was over, the resulting reaction solution was subjected to a vacuum distillation, so that an adduct (boiling point=87° C./0.7 mmHg) of 5-ethylidenenorbornene-2 and methylcyclopentadiene in a ratio of 1:1 was obtained in an amount of 241 g.

Then, in a 1-liter stainless steel autoclave, 300 g of the thus obtained 1:1 adduct and 8.1 g of a palladium-aluminum catalyst in which 0.2% of palladium was supported, and a reaction was then performed at 50° C. for 13 hours, while maintaining a hydrogen pressure at 11 kg/cm$^2$. After the reaction was over, the used catalyst was filtered off, and the resulting reaction solution was then subjected to a vacuum distillation in order to prepare 183 g of a hydrogenated product (boiling point=78° C./0.3 mmHg) of the aforesaid 1:1 adduct.

For the thus obtained hydrogenated product of the 1:1 adduct, an isomerization reaction was afterward performed as follows: Into a 1-liter three-necked flask was introduced 100 ml of hexane, and subsequently 5 g of aluminum chloride was added thereto with stirring. On the other hand, a solution of 102 g of the aforesaid hydrogenated product and 230 ml of hexane was prepared. This solution was then added with stirring to the above mentioned flask over 1.5 hours at room temperature by the use of a dropping funnel. After the completion of the dropping addition, the reaction temperature was elevated to 50° C. and the reaction was then allowed to go on for 8 hours. It was confirmed by a gas chromatography analysis that the hydride of the 1:1 adduct had reacted completely, and thus the reaction was brought to an end. The resulting reaction solution was washed with water, and vacuum distillation was then carried out in order to prepare 96 g of an isomerized product (73° to 82° C./0.3 mmHg).

The isomerized product had a freezing point of −78° C. or less, its specific gravity being 0.97 (15° C./4° C.), its net heat of combustion being 10,030 cal/g.

EXAMPLE 3

(1)

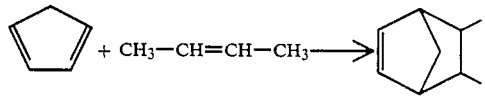

(2)

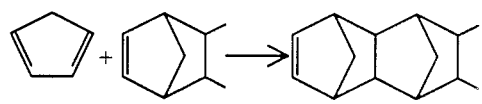

(3)

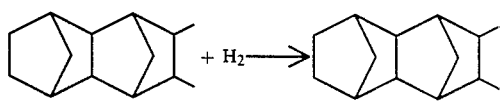

(4)

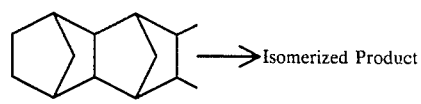

In a 2-liter stainless steel autoclave in which an atmosphere had been replaced with nitrogen were placed 331 g of cyclopentadiene and 283 g of 2-butene, and the autoclave was then slowly heated over 2 hours so as to elevate the temperature therein from 25° to 120° C. Afterward, a reaction was performed at 120° C. for 9 hours. After the completion of the reaction, the unreacted 2-butene was purged. The resulting reaction solution was then distilled under atmospheric pressure to remove the unreacted cyclopentadiene therefrom, and afterward a vacuum distillation was carried out to obtain 125 g of 5,6-dimethyl-2-norbornene.

The Diels-Alder reaction of this 5,6-dimethyl-2-norbornene with cyclopentadiene was performed in the same manner as in the preceding examples. That is, 119 g of 5,6-dimethyl-2-norbornene and 192 g of cyclopentadiene were placed in the autoclave, and heating was then carried out over 3 hours so that the temperature in the autoclave might rise from 25° to 120° C. Afterward, a reaction was performed at 120° C. for 7 hours. After the reaction was over, the resulting reaction solution was distilled under atmospheric pressure to remove the unreacted cyclopentadiene, followed by a vacuum distillation in order to obtain 80 g of an adduct fraction (106° C./3 mmHg) of cyclopentadiene and 2-butene at a ratio of 2:1.

Next, the atmosphere in a 500 ml stainless steel autoclave was replaced with nitrogen, and 78 g of the 2:1 adduct of cyclopentadiene and 2-butene, 100 ml of toluene and 0.6 g of Raney nickel were placed in the autoclave. Stirring was then carried out, and hydrogen was continuously introduced so as to reach a hydrogen pressure of 15 kg/cm$^2$, while maintaining a reaction temperature at 45° C. When 5 hours' reaction time had elapsed, the feed of hydrogen was stopped, and observation of any pressure drop was made. In consequence, it was confirmed that hydrogen was not consumed any more, and thus the resulting reaction solution was taken out. The used catalyst was then filtered off under a nitrogen gas flow, and the reaction solution was then subjected to a vacuum distillation, so that 74 g of a hydrogenated product of the 2:1 adduct was obtained at 114° C./4 mmHg.

This hydride of the 2:1 adduct was isomerized as follows: In a 1-liter three-necked flask, 15 g of concentrated sulfuric acid and 100 ml of 1,3-dichloropropane were placed, and 70 g of the above prepared hydrogenated product of the 2:1 adduct and 200 ml of 1,2-dichloropropane were added thereto at room temperature over 1 hour. After the completion of the addition, a reaction temperature was elevated up to 100° C., and reaction was further continued for 10 hours. After the reaction was over, the resulting reaction solution was washed with water, followed by a vacuum distillation, so that 65 g of an isomerized product (boiling point=105° to 119° C./4 mmHg) was prepared. The thus obtained isomerized product had a freezing point of −70° C. or less, a specific gravity of 0.983 (15° C./4° C.) and a net heat of combustion of 10,000 cal/g.

EXAMPLE 4

(1)

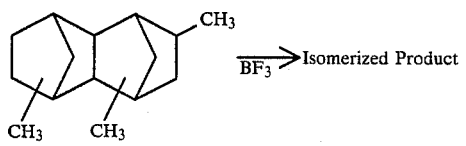

In the same manner as in Example 3 with the exception that dimethyldicyclopentadiene and propylene were used as raw materials, the Diels-Alder reaction and hydrogenation reaction were carried out to prepare a hydrogenated product of an adduct of methylcyclopentadiene and propylene in a ratio of 2:1, followed by an isomerization reaction.

In a 1-liter three-necked flask were placed 100 ml of 1,2-dichloroethane and 3 g of boron trifluoride, and a solution of 50 g of the above prepared hydride of the 2:1 adduct and 50 ml of 1,2-dichloroethane was added thereto at room temperature. Afterward, the resulting mixture was heated up to 50° C. and was reacted with stirring for 5 hours. After the completion of the reaction, water was added thereto so as to decompose the used catalyst. The resulting oil layer was washed with water, and a vacuum distillation was carried out to obtain 45 g of an isomerized product.

The thus obtained isomerized product had a freezing point of −70° C. or less, a specific gravity of 0.971 (15° C./4° C.) and a net heat of combustion of 9.980 cal/g.

What is claimed is:

1. A high-density fuel oil comprising an isomerized product prepared by isomerizing an alicyclic saturated hydrocarbon represented by the following formula in the presence of an acid catalyst:

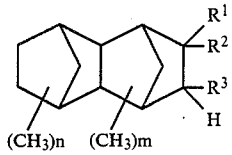

wherein each of m and n is 0 or 1, and each of $R^1$ to $R^3$ is a hydrogen atom or an alkyl group having 1 to 3 carbon atoms, and the number of the total carbons of $R^1$ to $R^3$ is within the range of 1 to 3.

2. The high density fuel of claim 1 wherein the hydrocarbon isomerized is

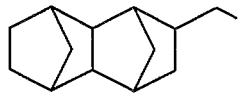

3. The high density fuel of claim 1 wherein the hydrocarbon isomerized is

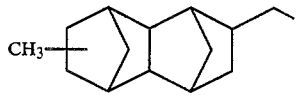

4. The high density fuel of claim 1 wherein the hydrocarbon isomerized is

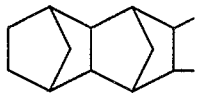

5. The high density fuel of claim 1 wherein the hydrocarbon isomerized is

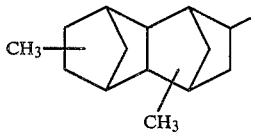

* * * * *